US008021237B2

(12) United States Patent
Akers

(10) Patent No.: US 8,021,237 B2
(45) Date of Patent: Sep. 20, 2011

(54) ROTATING VESSEL FOR RECREATIONAL ACTIVITIES

(75) Inventor: David Charles Akers, Tauranga (NZ)

(73) Assignee: Outdoor Gravity, Inc., Sevierville, TN (US)

( * ) Notice: Subject to any disclaimer, the term of this patent is extended or adjusted under 35 U.S.C. 154(b) by 26 days.

(21) Appl. No.: 12/508,056

(22) Filed: Jul. 23, 2009

(65) Prior Publication Data

US 2011/0021279 A1 Jan. 27, 2011

(51) Int. Cl.
*A63G 27/02* (2006.01)
*A63G 27/00* (2006.01)

(52) U.S. Cl. ..... 472/44; 472/130

(58) Field of Classification Search ..... 472/3, 29, 472/36, 43, 46, 47, 59, 130, 131, 136; 482/35, 482/36; 5/450, 451, 665, 670, 674
See application file for complete search history.

(56) References Cited

U.S. PATENT DOCUMENTS

| | | | | | |
|---|---|---|---|---|---|
| 5,052,932 | A * | 10/1991 | Trani | 434/29 |
| 5,556,340 | A * | 9/1996 | Bohn et al. | 472/59 |
| 5,558,582 | A * | 9/1996 | Swensen et al. | 472/43 |
| 5,603,185 | A * | 2/1997 | Murphy | 52/2.17 |
| 5,678,357 | A * | 10/1997 | Rubio et al. | 52/2.17 |
| 5,725,435 | A * | 3/1998 | De Castro Faria | 472/47 |
| 6,478,685 | B1 * | 11/2002 | Ochi | 472/136 |
| 6,875,119 | B2 * | 4/2005 | Murphy et al. | 472/134 |
| 6,910,971 | B2 * | 6/2005 | Alsenz | 472/59 |

* cited by examiner

*Primary Examiner* — Kien Nguyen
(74) *Attorney, Agent, or Firm* — Pitts, Lake & Bell, P.C.

(57) ABSTRACT

The present invention is a system for recreational purposes. The system includes a vessel rotatably mounted, a support stand, and a drive system. The vessel has a wall that defines an internal cavity, sufficient for at least one occupant to be received wherein the occupant is in contact with the wall, and a tunnel for accessing the internal cavity. The wall has dampens the contact between the occupant and the vessel. The support stand has two connectors carried by elevated members on opposing sides of the vessel for supporting the vessel. A drive system that includes a motor mechanically connected to at least one of the connectors for rotating the vessel and the occupant within the internal cavity.

30 Claims, 3 Drawing Sheets

ROTATING VESSEL FOR RECREATIONAL ACTIVITIES

CROSS-REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

1. Field of Invention

This invention relates to a system for recreational activity. More specifically, this invention relates to a system wherein an occupant is receivable within a rotatable vessel.

2. Description of the Related Art

Frequently people seek amusement and excitement through participation in games, amusement parks, roller-coasters, or other such activities (hereinafter "recreational activities"). The participants often utilize machines, structures, or other devices (hereinafter "recreational devices") to perform the desired recreational activities. These recreational activities occur on the ground, on platforms, involving water, or while descending from elevated altitudes. Additionally, some recreational devices are easily transportable between locations for providing recreational activities at parties or other events.

Recreational activities involving water have become increasingly popular. Typically, these recreational activities involve a recreational device around water, carrying water, in water, or near water. One example of a popular recreational device, that involves water, is a water slide. Traditional recreational devices, like the water slide, typically require a relatively large area when providing recreational activities for the general public. Furthermore, these traditional recreational devices often require permanent fixtures. For example, a public water slide typically requires a permanent swimming pool and a permanent support structure to achieve a desired slope. The permanent fixtures and required slope directly contribute to the increased size and decreased portability of the recreational device.

Other recreational activities include using recreational devices for rotating a person within the recreational device. Generally, these recreational devices may be mechanically rotated about an axis, propelled by the occupant, or rotated while travelling down a slope. First, the rotating devices, which are mechanically rotated about an axis, are typically made from solid materials and require the riders to be harnessed inside before being rotated. Although these recreational devices are portable they still lack the ability to become a recreational activity involving water. Second, recreational devices, which are propelled by the occupant, lack portability because they require an area sufficient for full rotation. Furthermore, when water is incorporated in the recreational device the inertia of the recreational device increases thereby reducing the occupants ability to rotate the recreational device. Third, recreational devices, which are rotated while travelling down a slope, lack portability because they require an area sufficient for travel and large enough slope to rotate the recreational device. Although these recreational devices have incorporated water into the device, these recreational devices still lack portability to locations because of the required slope.

BRIEF SUMMARY OF THE INVENTION

A system for recreational purposes is shown and described herein. The system includes a vessel rotatably mounted, a support stand, and a drive system. The vessel has a wall that defines an internal cavity, sufficient for at least one occupant to be received wherein the occupant is in contact with the wall, and a tunnel for accessing the internal cavity. The wall has cushioning for dampening the contact between the occupant and the vessel. The support stand has two connectors carried by the elevated members on opposing sides of the vessel for supporting the vessel. A drive system that includes a motor mechanically connected to at least one of the connectors for rotating the vessel and the occupant within the internal cavity.

Adding water inside the vessel and sealing the tunnel allows the riders to sit, slide, run or otherwise ride inside the rotating vessel. Riders can ride tubes, rafts, boogie boards or other small water craft inside the vessel. Alternately, riders can be harnessed to the interior cavity. The present invention enables rides of variable length and speed without requiring a large amount of space, a water pool, a slope, or a means of returning the device to the start point after a ride. The wall's cushioning means riders are cushioned from falls. The device is easily controlled by varying the motor speed, and is not subject to environmental variations such as wind. The vessel can be made with or without a harnessing system inside for the riders. The device can be set up as a static unit at a location, or mounted on a trailer and transported to sites for temporary operation.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A system for recreational purposes is shown and described in detail herein. The system includes a vessel rotatably mounted, a support stand, and a drive system. The vessel has a wall that defines an internal cavity, sufficient for at least one occupant to be received wherein the occupant is in contact with the wall, and a tunnel for accessing the internal cavity. The wall dampens the contact between the occupant and the vessel. The support stand has two connectors carried by the elevated members on opposing sides of the vessel for supporting the vessel. The drive system includes a motor mechanically connected to at least one of the connectors for rotating the vessel.

Figure 1:
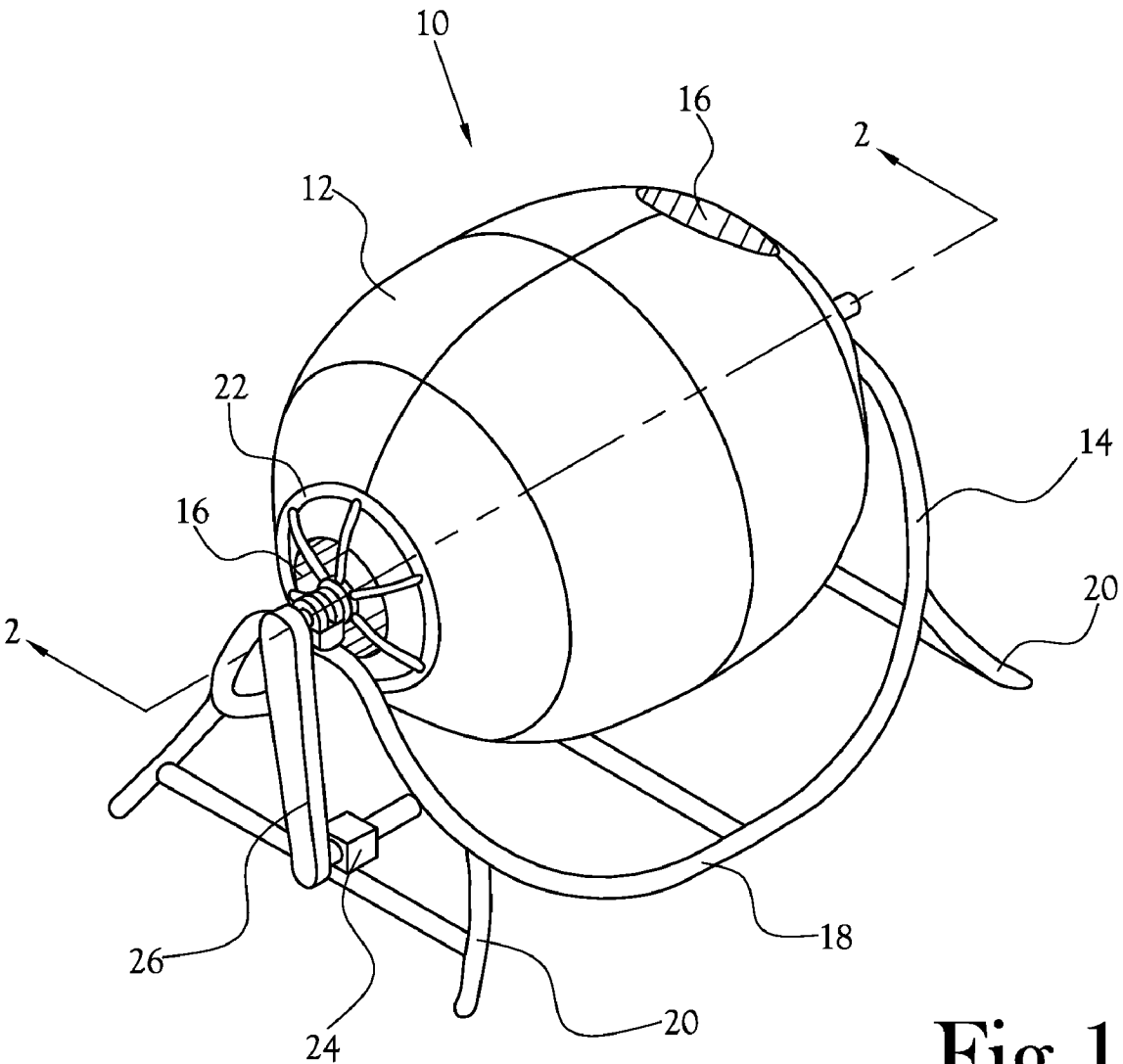
FIG. 1 is a perspective view of one embodiment of the system.

Accordingly, a system for recreational purposes is illustrated generally at 10 in the Figures. Referring to FIG. 1, in the illustrated embodiment of the present invention, the system 10 includes a vessel 12, a support stand 14, and a drive system.

The vessel 12 is a body that receives at least one occupant within the vessel 12. The vessel 12 having at least one layer comprising a non-rigid material to dampen contact between the occupant and the vessel 12. In the illustrated embodiment, the vessel 12 is an ellipsoid having an area for carrying an occupant. In alternate embodiments, the vessel 12 can include any shaped body for carrying an occupant within the vessel.

The vessel 12 further includes at least one tunnel 16 for providing access to the area where the occupant is received by the vessel 12. In the illustrated embodiment, the vessel 12 shows two tunnels 16 that provide access to the area that carries the occupant. In this embodiment, the openings 16 may provide ingress, egress, ventilation, or other desirable reason to access the area. In alternate embodiments, the vessel 12 can include any desired number of tunnels 16 into the vessel 12 for providing access to the area where the occupant is carried by the vessel 12.

Generally, the support stand 14 provides a stabilized base for the vessel 12. In the illustrated embodiment, the support stand 14 includes at least one rigid member which, directly or indirectly, supports the vessel 12. More specifically, the structure includes a vessel member 18 that follows the curvature of two sides of the vessel 12 at a selected outward distance. The vessel member 18 has two elevated sides, at opposing sides of the vessel member 18, and two low sides, perpendicular to the elevated sides of the vessel member 18, in physical communication with the ground beyond the vessel 12. This support stand 14 further includes support members 20, for additional stability, between the ground and vessel member 18 at a plurality of locations. In the illustrated embodiment, the support stand 14 further includes two connectors 22 in direct contact with the vessel 12. The connectors 22 are rotatably mounted to the elevated sides of the vessel member 14 such that rotation of a connector 22 generates rotation in the vessel 12. In alternate embodiments, the support stand 14 can otherwise support the vessel 12 without departing from the spirit and scope of the present invention.

The drive system provides for the rotation of the vessel 12. In the illustrated embodiment, the drive system includes a motor 24. In alternate embodiments, the drive system can otherwise rotate the vessel 12 without departing from the spirit and scope of the present invention.

Generally, the motor 24 is in mechanical communication with the vessel 12. In the illustrated embodiment, the motor 24 is in mechanical communication with the vessel 12 via one connector 24. More specifically, in this embodiment, the mechanical communication occurs within a safety housing 26. The motor 24 generates rotation in the connector 22 and thereby generates rotation in the vessel 12. In alternate embodiments, the drive system can otherwise rotate the vessel 12 without departing from the spirit and scope of the present invention.

Figure 2:
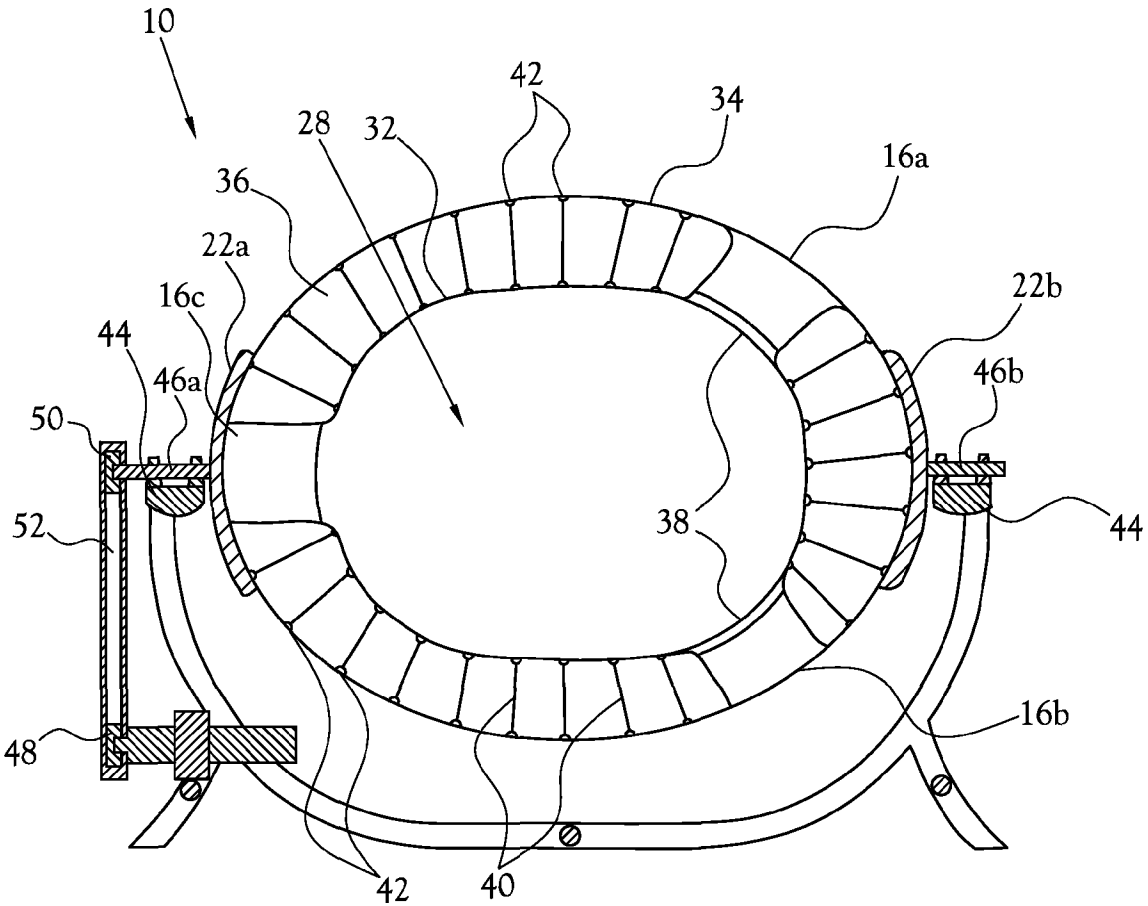
FIG. 2 is a sectional view of the system illustrated in FIG. 1.

FIG. 2 illustrates a sectional view of one embodiment of the system 10 as illustrated in FIG. 1. In the illustrated embodiment, details regarding aspects of the system 10, namely the vessel 12, the support stand 14, and the drive system, are more readily ascertainable.

Generally, the vessel 12 has a wall that defines an internal cavity 28 and an exterior surface 30 of said vessel 12. The wall has at least one layer comprising a non-rigid material to dampen contact between the occupant and the wall. In the illustrated embodiment, the vessel 12 has a plurality of layers that includes an inner layer 32 and an outer layer 34 being separated by a chamber 36 therebetween. In alternate embodiments of the present invention, the wall of the vessel 12 can include chambers 36, cavities 28, or otherwise provide for receiving an occupant within a vessel 12.

As previously shown, the vessel 12 has at least one tunnel 16 into the area where the occupant is received within the vessel 12. In the illustrated embodiment, the vessel 12 includes three tunnel 16 into the internal cavity 28, namely a first tunnel 16*a*, a second tunnel 16*b*, and a third tunnel 16*c*. More specifically, the first tunnel 16*a* and second tunnel 16*b* provide ingress and egress for the occupant and the third tunnel 16*c* provides ventilation to the internal cavity 28. In the illustrated embodiment, the tunnel 16 extends from the exterior surface 30 to the inner layer 32 and defines a path between the internal cavity 28 and outside environment. In alternate embodiments, the vessel 12 can include any desired number of tunnels 16 into the vessel 12 for ingress, egress, ventilation, or for otherwise accessing the internal cavity 28.

Furthermore, in the illustrated embodiment, the first tunnel 16*a* and second tunnel 16*b* are closable to prevent passage of the occupant through the tunnel 16. More specifically, a seal 38 is releasably secured, by a zipper accessible from the inside, near the inner layer 30 and the tunnel 16. When releasably secured, the seal 38 being substantially flush with the inner surface 32 of the vessel 12 thereby preventing ingress and egress of the internal cavity 28. In alternate embodiments, the tunnel 36 may be sealed by releasable panels, inflatable plugs, outer doors, or other releasable way of securing without departing from the spirit and scope of the present invention.

The wall of the vessel 12 dampens the contact between the wall and the carried occupant. In the illustrated embodiment, the inner layer 32 and the outer layer 34 are a non-rigid flexible material and the chamber 36 is inflated with air. The effect is a vessel 12 with enough support to carry an occupant and having a cushioned outer layer 34 and a cushioned inner layer 32 for reducing the likelihood of injuries from the occupant's contact against the wall. In an alternate embodiment, the vessel 12 may include a rigid material on the outer layer 34 and a non-rigid material for the inner layer 32 to improve structural integrity while still using a chamber 36, inflated with air, to dampen contact between the inner layer 32 and the carried occupant. It should be noted, the vessel 12 can dampening contact between the inner layer 32 and the carried occupant in ways other than described above including, but not limited to, placing a foam pad about the inner layer 32, equipping the occupant with protective gear, etc., without departing from the spirit and scope of the present invention.

The vessel 12 has an associated structural integrity for maintaining its shape. In one embodiment, the wall includes supports for controlling the distance between the inner layer 32 and outer layer 34. In the illustrated embodiment, the wall comprises a plurality of strings 40 wherein each string 40 is secured at one end to the inner layer 32 and at a second end to the outer layer 28. More specifically, the wall has a plurality of strings 40 connected between anchor points 42 adhesively affixed to the inner layer 32 and the outer layer 34. It should be noted, that the wall can control compression or expansion in ways other than those described, including, but not limited to, bands, straps, hoops, or rigid members, without departing from the spirit and scope of the present invention.

Generally, the support stand 14 provides a stabilized base for the vessel 12. In the illustrated embodiment, the support stand 14 includes a first connector 22*a*, a second connector 22*b*, and at least one rigid member that support the first connector 22*a* and the second connector 22*b*. In alternate embodiments, the support stand 14 can otherwise support the vessel without departing from the spirit and scope of the present invention.

The support stand includes at least one elevated member at opposing sides of the vessel 12. In the illustrated embodiment, the support stand 14 includes a vessel member 18 that follows the curvature the vessel 12 at a selected outward distance and two support members 20 for supporting the vessel member 18. Furthermore, the support stand 14 has two elevated sides, at opposing sides of the vessel member 18, which include brackets 44 for supporting the first connector 22*a* and the second connector 22*b* and defining an axis therebetween.

In the illustrated embodiment, one side of the first connector 22*a* and the second connector 22*b* are in direct communication with the vessel 12. The opposing sides of the first connector 22*a* and the second connector 22*b* each have a rotatably mounted connector shaft 46, a first connector shaft 46*a* and a second connector shaft 46*b* respectively. In alternate embodiments, the connectors 22 may otherwise be in contact with the vessel 12 and provide for cooperation with the support stand 14.

The first connector 22*a* and the second connector 22*b* are supported by the elevated sides of the support stand 14. In the illustrated embodiment, the first connector 22*a* and the second connector 22*b* are supported by the vessel member 18 at the first connector shaft 46*a* and the second connector shaft 46*b*, respectfully. More specifically, the first connector shaft 46*a* and the second connector shaft 46*b* are rotatably mounted to the brackets 44 on the vessel member 18. It should be noted, in alternate embodiments, the first connector 22*a* and the second connector 22*b* can be supported by the vessel member 18 in ways other than described above.

The drive system provides for the rotation of the vessel 12. In the illustrated embodiment, the drive system includes a motor 24 in communication with the vessel 12. In the illustrated embodiment, the motor 24 is in communication with the first connector shaft 46*a*. More specifically, the motor 24, having a drive gear 48, is in communication with a connector gear 50, on the first connector shaft 46*a*, via a drive belt 52. Activation of the motor 24 results in a reaction that causes the rotation of the drive gear 48, the movement in the drive belt 52, the rotation of the connector gear 50, the rotation of the first connector shaft 46*a*, the rotation of the first connector 22*a*, and the resulting rotation of the vessel 12. It should be noted, in one embodiment, the drive system provides for rotation of the vessel 12 by propulsion from the occupant inside. In alternate embodiments, the drive system can otherwise be in communication with the vessel 12 without departing from the spirit and scope of the present invention.

Figure 3:
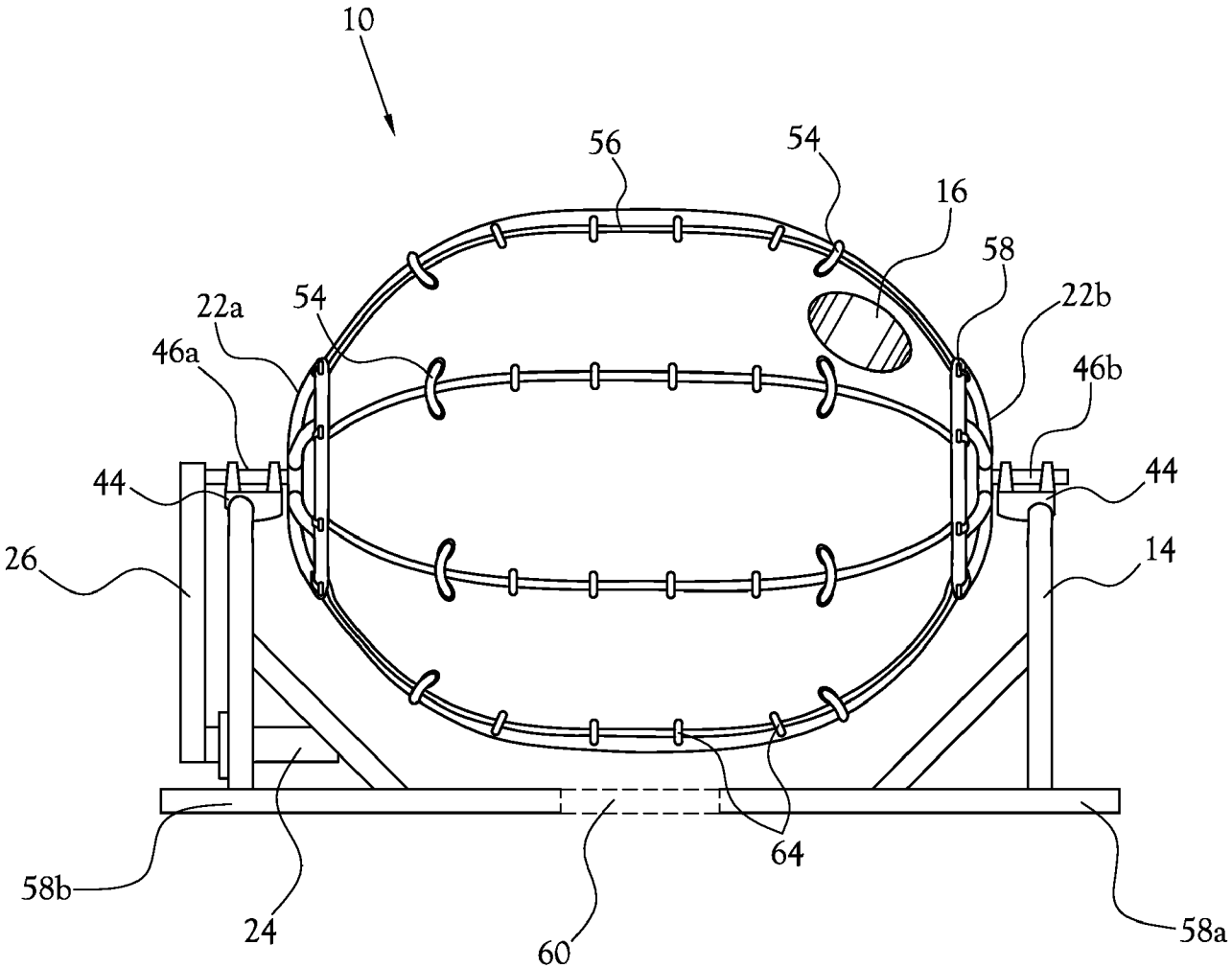
FIG. 3 is an alternate embodiment of the system.

FIG. 3 illustrates an alternate embodiment of the system 10. In this embodiment, the vessel 12 has a non-rigid material the inner layer 32 and the outer layer 34 forming a chamber 36 that is inflated with air. Additionally, the chamber 36 has a plurality of strings 40 connected at selected anchor points 42 between the inner layer 32 and the outer layer 34. The vessel 12 further includes two tunnels 16 into the internal cavity 34, namely a first tunnel 16*a* and a second tunnel 16*b*. The first tunnel 16*a* provides ingress and egress for the occupant and is closeable, by a releasably securable seal 38, to prevent passage through the first tunnel 16*a*. The second tunnel 16*b* provides ventilation to the internal cavity 28. Furthermore, the vessel 12 includes a plurality of handles 54 mounted to the exterior surface 30 to aid in transporting the system 10.

In this embodiment, the support stand includes two connectors 24, and a plurality of straps 56. The connectors in conjunction with a plurality of straps 56 provide increased structural support for carrying the vessel 12 and assisting in the harmonious rotation of the connectors. In the illustrated embodiment, the support stand 14 has two elevated members 58*a* and 58*b*, at opposing sides of the vessel 12, which independently support its respective side of the vessel 12. The elevated members 58 have brackets 44 that support a respective connector 24. In alternate embodiments, the support stand 14 may include a joining member 60 that extends between the elevated members 58 and allows for the expansion and contraction, between the elevated members 58, of the support stand 14 during use.

The support stand 14 includes two connectors 24, namely a first connector 24*a* and a second connector 24*b*, for supporting opposing sides of the vessel 12. More specifically, the connectors are ring-shaped to receive opposing sides of the vessel 12. Each of the connectors 24 has a rotatably mounted connector shaft 46 receivable within the brackets 44. The two connectors 24, in addition to supporting the vessel 12, provide strap brackets 62 for mounting the plurality of support straps 56.

The plurality of straps 56 assists in the rotation of the vessel 12 by controlling the rotational forces between the connectors 24 and vessel 12, thereby ensuring the vessel 12 rotates harmoniously with the connectors 24. The straps 56 are secured to each connector 24 at a plurality of spaced points along the connectors 24. More specifically, each strap 56 extends between the connectors 24 at corresponding locations. In this embodiment, the two connectors 24, in addition to supporting the vessel 12, provide strap brackets 62 for mounting the plurality of straps 56. Furthermore, the straps 56 are directed along the vessel 12 by a plurality of strap guides 64 on the exterior surface 30 of the vessel 12 at selected intervals. The strap guides 64 are guides that direct the path of the straps 56 and allow for uniform coverage of the straps 56 over the exterior surface 30 of the vessel 12. In one embodiment, the length of the straps 56 can be adjusted to allow for the vessel 12 to expand and contract during use. It should be noted, in alternate embodiments, the support stand 14 may include connectors extending across a portion of the exterior surface 30 of the vessel 12, rigid straps about the exterior surface 30 of the vessel 12, or the support stand 14 may otherwise control the rotational forces between the connectors and the vessel 12 without departing from the sprit and scope of the present invention.

In the illustrated embodiment, the drive system is carried by the support stand 14. In this embodiment, the drive system includes a motor 24 is in communication with the vessel 12. More specifically, the motor has a drive gear 48 in communication, via a drive belt 52, with a connector gear 50 on the first connector shaft 46*a*. Running the motor 24 results in rotation of the drive gear 48, the movement in the drive belt 52, the rotation of the connector gear 50, the rotation of the first connector shaft 46*a*, the rotation of the first connector 22*a*, and the resulting rotation of the vessel 12.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A system for recreational purposes, said system comprising:

a vessel having a wall defining an internal cavity adapted to carry at least one occupant and an exterior surface of said vessel, said wall further comprising a plurality of layers, said plurality of layers comprising an inner layer and an outer layer, said inner layer and said outer layer being separated by a chamber, said vessel defining at least one tunnel through said wall, said tunnel providing access to said internal cavity;

a support stand having a first connector and a second connector adapted for carrying said vessel, said first connector rotatably mounted to a first elevated member at a first side of said vessel and said second connector rotatably mounted to a second elevated member at a second side of said vessel wherein said first connector and said second connector define an axis through said vessel; and a drive system having a motor in mechanical communication with said first connector, said motor is adapted for rotatably driving said first connector and thereby rotating said vessel about said axis while carrying said occupant.

2. A system for recreational purposes of claim 1, wherein said first connector includes a first shaft rotatably mounting said first connector on said support and said second connector includes a second shaft rotatably mounting said second connector on said support and wherein said motor is mechanically connected to said first shaft for rotatably driving said first connector and thereby produce rotating said vessel.

3. A system for recreational purposes of claim 1, wherein said chamber is substantially air-tight and is adapted for inflation.

4. A system for recreational purposes of claim 1, wherein said axis is substantially horizontal.

5. A system for recreational purposes of claim 1, wherein said at least one tunnel provides the occupant ingress and egress to said internal cavity in addition to ventilation.

6. A system for recreational purposes of claim 1, wherein said at least one tunnel further comprising at least one first tunnel and at least one second tunnel, said at least one first tunnel providing the occupant ingress and egress to said internal cavity, said at least one second tunnel providing ventilation into said internal cavity.

7. A system for recreational purposes of claim 1, further comprising a seal adapted to be releasably secured proximate to said at least one tunnel and said internal cavity, said seal defining a barrier being substantially flush with said internal cavity of said vessel when releasably secured thereto and thereby preventing access to said internal cavity through said at least one tunnel.

8. A system for recreational purposes of claim 1, further comprising a liquid, said liquid being in sufficient amount for the recreational purpose, said liquid is carried in said internal cavity whereby the rotation of said vessel results in said liquid flowing over said inner surface of said vessel.

9. A system for recreational purposes of claim 1, wherein said inner layer and said outer layer are connected to control the spacing therebetween.

10. A system for recreational purposes of claim 1, comprising a plurality of straps, each strap of said plurality of straps are secured to said first connector and said second connector at spaced locations, said plurality of straps extend between said first connector and said second connector thereby extending over said vessel.

11. A system for recreational purposes of claim 10, comprising a plurality of strap brackets mounted to said first connector and said second connector at said spaced locations, said plurality of strap brackets adapted for mounted said plurality of straps to said first connector and said second connector.

12. A system for recreational purposes of claim 10, further comprising a plurality of strap guides, said plurality of strap guides disposed on said outer surface of said vessel at spaced locations for receiving said plurality of straps at the selected interval.

13. A system for recreational purposes, said system comprising:

a vessel having a wall defining an internal cavity and an exterior surface of said vessel, said internal cavity adapted to receive an occupant wherein said occupant is in contact with said wall, said wall having at least one layer comprising a non-rigid material to dampen contact between said occupant and said wall, said vessel defining at least one tunnel through said wall, said tunnel providing access to said internal cavity;

a support stand having a first connector and a second connector adapted for carrying said vessel, said first connector rotatably mounted to a first elevated member at a first side of said vessel and said second connector rotatably mounted to a second elevated member at a second side of said vessel wherein said first connector and said second connector define an axis through said vessel; and a drive system having a motor in mechanical communication with said first connector, said motor is adapted for rotatably driving said first connector and thereby rotating said vessel about said axis while carrying said occupant.

14. A system for recreational purposes of claim 13, wherein said wall further comprising a plurality of layers including an inner layer and an outer layer, said inner layer and said outer layer being separated by a chamber adapted for inflation wherein effects of a inflated chamber includes cushioning to dampen contact between said occupant and said wall.

15. A system for recreational purposes of claim 14, wherein said inner layer and said outer layer are connected to control the spacing therebetween.

16. A system for recreational purposes of claim 14, wherein said chamber is substantially air-tight and is adapted for inflation.

17. A system for recreational purposes of claim 13, wherein said wall includes cushioning to dampen contact between said occupant and said wall.

18. A system for recreational purposes of claim 13, wherein said first connector includes a first shaft rotatably mounting said first connector on said support and said second connector includes a second shaft rotatably mounting said second connector on said support and wherein said motor is mechanically connected to said first shaft for rotatably driving said first connector and thereby produce rotating said vessel.

19. A system for recreational purposes of claim 13, wherein said axis is substantially horizontal.

20. A system for recreational purposes of claim 13, wherein said at least one tunnel provides the occupant ingress and egress to said internal cavity in addition to ventilation.

21. A system for recreational purposes of claim 13, wherein said at least one tunnel further comprising at least one first tunnel and at least one second tunnel, said at least one first tunnel providing the occupant ingress and egress to said internal cavity, said at least one second tunnel providing ventilation into said internal cavity.

22. A system for recreational purposes of claim 13, further comprising a seal adapted to be releasably secured proximate to said at least one tunnel and said internal cavity, said seal defining a barrier being substantially flush with said internal cavity of said vessel when releasably secured thereto and thereby preventing access to said internal cavity through said at least one tunnel.

23. A system for recreational purposes of claim 13, further comprising a liquid, said liquid being in sufficient amount for the recreational purpose, said liquid is carried in said internal cavity whereby the rotation of said vessel results in said liquid flowing over said inner surface of said vessel.

24. A system for recreational purposes of claim 13, comprising a plurality of straps, each strap of said plurality of straps are secured to said first connector and said second connector at spaced locations, said plurality of straps extend between said first connector and said second connector thereby extending over said vessel.

25. A system for recreational purposes of claim 24, comprising a plurality of strap brackets mounted to said first connector and said second connector at said spaced locations, said plurality of strap brackets adapted for mounted said plurality of straps to said first connector and said second connector.

26. A system for recreational purposes of claim 24, further comprising a plurality of strap guides, said plurality of strap guides disposed on said outer surface of said vessel at spaced locations for receiving said plurality of straps at the selected interval.

27. A vessel rotatably mountable to a support stand, said vessel comprising:

a wall defining an internal cavity to receive a person therein, said wall including a non-rigid material to dampen contact between the person and said wall; and at least one tunnel defined through said wall to provide an opening between said internal cavity and an outside of said vessel, wherein said vessel is mountable to the support stand via a connector which is driven by a drive system to facilitate rotation of said vessel relative to the support stand.

28. The vessel of claim 27 wherein said vessel is secured to the support stand by first and second connectors which attach to first and second sides of said vessel to secure said vessel to the support stand.

29. The vessel of claim 28 further comprising a plurality of strap guides, said plurality of strap guides disposed to an outer surface of said vessel at spaced locations to receive a plurality of straps extending between said first and second connectors at a selected interval.

30. The vessel of claim 27 wherein said wall comprises an inner layer and an outer layer, wherein the inner layer and the outer layer are separated by a chamber.

* * * * *